US005455562A

United States Patent [19]

Chin

[11] Patent Number: 5,455,562

[45] Date of Patent: Oct. 3, 1995

[54] HOME INTRUDER INDICATOR 2

[76] Inventor: Suey N. Chin, 6928 Bonnot Dr., Norfolk, Va. 23513-1102

[21] Appl. No.: 36,964

[22] Filed: Mar. 25, 1993

[51] Int. Cl.[6] ..... G08B 13/08

[52] U.S. Cl. ..... 340/547; 340/542

[58] Field of Search ..... 340/547, 545, 340/505, 628, 693, 528, 691, 540, 542, 567, 514; 174/35 R; 248/551; 292/251.5; 361/170; 204/130.8

[56] References Cited

U.S. PATENT DOCUMENTS

| | | | |
|---|---|---|---|
| 3,658,676 | 4/1972 | De Vittorio et al. | 204/180.8 |
| 3,833,895 | 9/1974 | Fecteau | 340/505 |
| 4,422,068 | 12/1983 | Helft | 340/514 |
| 4,427,975 | 1/1984 | Kinzie | 340/547 |
| 4,763,937 | 8/1988 | Sittnick, Jr. et al. | 340/542 |
| 4,990,898 | 2/1991 | Greene | 340/547 |
| 5,087,908 | 2/1992 | Sanders, Jr. et al. | 340/567 |

*Primary Examiner*—John K. Peng
*Assistant Examiner*—Benjamin C. Lee

[57] ABSTRACT

A passive home security meter indicator which will show the returning occupant(s) at the front entrance whether or not the front door has been opened and security status compromised. If a security status has been compromised, a D'arsonval Meter Movement will show a repetitive sweeping meter indication visible at the front entrance. This equipment operates on 120 VAC commercial power through an AC ADAPTER as primary power. A set of 4 regular "D" size alkaline flashlight battery and a 6 volt alkaline lantern battery are used as 200% back-up power. For a 5 to 10 hour day operation, a set of 14 ampere-hour (a-h) alkaline flashlight battery may last 5 to 10 months while a 27 a-h alkaline lantern battery may last 9.5 to 19 months. The life expectancy of these batteries is typically from three to four years when a 12 VDC AC ADAPTER is used as primary power. An instantaneous automatic power changeover circuit is incorporated to allow the power failures of the primary power along with one of the two back-up battery powers to occur simultaneously or sequentially without interrupting the normal operation of the equipment. This equipment can safely operate with as little as 6 milliamperes on a 6 volt DC power source of supply.

1 Claim, 2 Drawing Sheets

PREFAB CABLE 9 FT

MAG SENSOR ASSY
MAIN CONTROL ASSY
PREFAB CABLE 6 FT
AC ADAPTER
METER IND ASSY
120 VAC RECEPT
INSIDE DOOR

1 AC ADAPTER
2 BATTERY 6 VDC
3 VOLTAGE RGLTR AND AUTOMATIC PWR XFR DEVICE
4 CONVENTIONAL AND ELECTRONIC COMBINATION POWER SWITCH
5 SIGNAL GENERATOR AND 40 SECOND TIME DELAY
6 GREEN INDICATOR
7 SIGNAL INVERTER
8 MAGNETIC SENSOR
9 METER CONT
10 METER IND

HOME INTRUDER INDICATOR 2

CROSS-REFERENCES TO RELATED APPLICATIONS

| | DOC NO. | DATE | NAME | CL | SUBCL |
|---|---|---|---|---|---|
| (1) | 4427975 | 1/1984 | Kinzie | 340 | 547 |
| (2) | 3833895 | 9/1974 | Fecteau | 340 | 528X |
| (3) | 4796010 | 1/1989 | Bland et al. | 340 | 541 |
| (4) | 4422068 | 12/1983 | Helft et al. | 340 | 541X |
| (5) | 5087908 | 2/1992 | Sanders, Jr. et al. | 340 | 528X |
| (6) | 4763937 | 8/1988 | Sittnick, Jr. et al. | 340 | 542X |
| (7) | 4990898 | 2/1991 | Greene | 342 | 547 |
| (8) | 3658676 | 4/1972 | DeVittorio et al | 204 | 180.8 |

BACKGROUND OF THE INVENTION (1) Field of Invention

This invention relates to security devices and specifically to security devices that indicate by a D'arsonval meter movement indicator. This meter indicating system consist of three separate assemblies as follow:

1. The Magnetic Sensor assembly

Reference FIG. 1. It is made up with a 9 foot, four conductor cable connected to the magnetic sensor terminals. The Magnetic Sensor itself consist of two parts. Part A is a magnetized device which is mounted on the door. Part B is a two terminal device with two magnetizing electrodes in it. And these electrodes are arranged in such a manner so that the electrodes are normally open circuit whenever a magnetized device is lined up within ⅛ to ¼ inch away from each other so that the magnetic flux is acting on the magnetizing electrodes without any physical contact, such as with Part A, otherwise it is a short circuit condition between the two terminals on Part B. Part B is mounted on the stationary door frame aligned with Part A. The entire magnetic sensor assembly is mounted with 4 screw fasteners on the upper left corner of the front door and door frame to provide means of sensing a closed door being opened.

2. The D'arsonval Meter Movement Indicator assembly

Reference FIG. 1. The D'arsonval Meter Movement Indicator assembly is fabricated with a D'arsonval meter movement placed in a 1.063 inch diameter hole located near the end of a piece wood, size 5"L×1.5"W×1.5" thick. Then the Meter Indicator is connected with a 6 foot, four conductor cable. The Meter Indicator assembly is mounted with 4 screw fasteners on the inside front door but visible from the outside to provide means of displaying an opened door status.

3. The Main Control assembly

Reference FIG. 1. The Main Control assembly is a box with a hinge on the left side door. It contains switch controls, indicators, batteries, a printed circuit board with active and passive devices to create electronic circuits to provide means to remember the status of an opened door and controls the display status of an opened door. The Main Control assembly is mounted with 4 screw fasteners near the front door within 6 feet to a 120 VAC receptacle.

(2) Description of Prior Arts

Reference (b) (1)-j.e.k. Prior Art is a well designed system with a keyboard input to gain access control to the unit. However, having a push button keyboard located outside of the protected area is subject to children's play. Whether it will be intentional or unintentional, keyboard damage by children is inevitable. Another difference in opinion is that having identical battery power sources for both the primary and the back-up power supply are not very practical for many of us who have to leave the house at least 5 to 10 hour period each day for work. The user would be very likely to replace batteries frequently about once every 3 to 6 days for a 9 volt alkaline battery with 565 milliampere-hour (mah) capacity. However, the present invention, on the contrary, will use the commercial power as the primary source. And as for the back-up power, a set of four standard "D" size alkaline flashlight battery with 14,250 mah capacity that will last from 5 to 10 months, and a 6 volt lantern battery with 27,000 mah capacity that will last from 9.5 to 19 months to provide 200% power back-up. Other physical feature differences are including coded input means, door actuated switch, auxiliary output jack, low battery indicator, and power failure transfer mode. Also, there are differences in circuit configurations to energize the indicator. Prior Art use a 30 second delay signal through one 3-state counter, two "AND" gates, one "OR" gate, and one flasher to energize the indicator. The present invention uses 40 second delay signal, one inverter, one SCR and and one astable multivibrator to energize the D'arsonval Meter Movement Indicator, and reduced the active devices by ⅓ or 33 percent. The D'arsonval Meter Indicator sweeps from 0 through 75% full scale deflection as a warning signal only when the front door has been opened, but the opposite is true for the Prior Art design of the Unopened-Door Indicator where it provides no warning signal at all.

Ref (b) (2)-d.e.f. The Prior Art in contrast is a security device that uses a modulated radio frequency signal radiated by a transmitting antenna and that a receiver is use to pick up the radiated signal, demodulates it, then use the demodulated signal as a control mode to activate alarm, resetting, initiating delays, etc.. It also differ in electronic circuit configuration and in the use of active devices to provide an audible alarm. Perhaps the major difference is that the modulated radio frequency carrier links between the radio receiver and the combination of the window/fire, door, and the hand-held units, to control the undesirable events.

Ref (b) (3)-r.t.b. Prior Art is different in electronic circuit configuraion, and in the use of active devices to provide an audible intrusion alarm and an automatic illumination system.

Ref (b) (4)-j.m.h. The Prior Art is different in electronic circuit configuration, and in the use of different active devices to provide an audible alarm system.

Ref (b) (5)-w.a.s. Prior Art is different in objective, circuit design, and the use of active devices for the portable alarm system with automatic operating state transferral.

Ref (b) (6)-r.a.s. Prior Art is different in objective, circuit design and the use of active devices for the electromagnetic door lock.

Ref (b) (7)-t.r.g. Prior Art is a Surface-mount intrusion detection switch housing involving a magnetically sensitive switch unit. In contrast, it does not have any active or passive electrical components for electronic circuitry such as IC chips, SCR's, power sources and indicating device like the D'arsonval meter.

Ref (b) (8)-j.m.d. Prior Art is a monitor device with probes to sense and to measure the condition of non-volatile matter concentration, temperature, resistivity, and FH levels with compensation for a desired result. In contrast, it does not have a magnetic sensor, silicon controlled rectifier, D'arsonval meter or back-up power sources with automatic power changeover when primary power fails.

SUMMARY

There are countless number of home security devices available in the market place today, but none of the designs seem to address the COST EFFECTIVENESS and the RELIABILITY of such devices through COMPONENT REDUCTION. Component reduction can provide a substantial savings in material and labor cost by keeping the design simple and minimize the use of active and passive devices. The use of fewer devices in general (especially the active devices) will relates to less component failure caused by excessive heat and less current drain on the back-up battery so that longer anticipated trouble free operations can be realized. This design of a Home Intruder Indicator 2 addresses that concern of reducing the number of active and passive devices to a minimum. Thus minimized the current drain from the back-up batteries and increase the battery life and operational efficiency. For example, a set of four standard "D" size alkaline flashlight battery with 14,250 mah capacity will last 5 to 10 months duration for a 5 to 10 hour day operation, and a 6 volt lantern alkaline battery with 27,000 mah capacity will last 9.5 to 19 months. With 200% power back-up, and the automatic power selection circuit already incorporated, any power failures will not interrupt the normal operation of the unit. An electronic switch is also incorporated to deter any stranger or unauthorized individual to turn off the Home Intruder Indicator 2 without knowing the system shut down procedure.

This device also provides a small high impedance 6 volt auxiliary signal at terminal board (TB1). This signal has a variable delay time from 50 seconds to 480 seconds duration in reference to the opening of the front door, S3 closed. The delay is accomplished through the R-C time constant network of C5, R7, R8, IC2B and IC2C. The user may use this delay signal for energizing or de-energizing other devices at the user's discretion. This inventor is the same person who invented the Home Intruder Indicator now pending patent application, Ser. No. 915,628. The Home Intruder Indicator 2 will provide an alternative option to the consumers since it has an entirely new different type of improved indicator, a meter (It is much easier to see a meter movement indicator size 1.25 inch square during any intensely bright daylight hour than you can see a tiny 0.2 inch diameter red light indicator). The circuit configuration of this new device also has been optimized with new replacement parts and reduced the power consumption by more than 50%.

BRIEF DESCRIPTION OF THE DRAWING(S)

FIG. 1 shows a perspective view of the entire system and the relative location for each of the major assemblies which including the AC Adapter, Magnetic Sensor, Meter Indicator, and the Main Control assembly.

FIG. 2, a block diagram, shows the functions of each block and the sequence of events.

FIG. 3, a schematic diagram, shows all the active and passive devices and the configurations of the electronic circuits to suit requirements.

DESCRIPTION OF THE PREFERRED EMBODIMENT(S)

Figure 1:
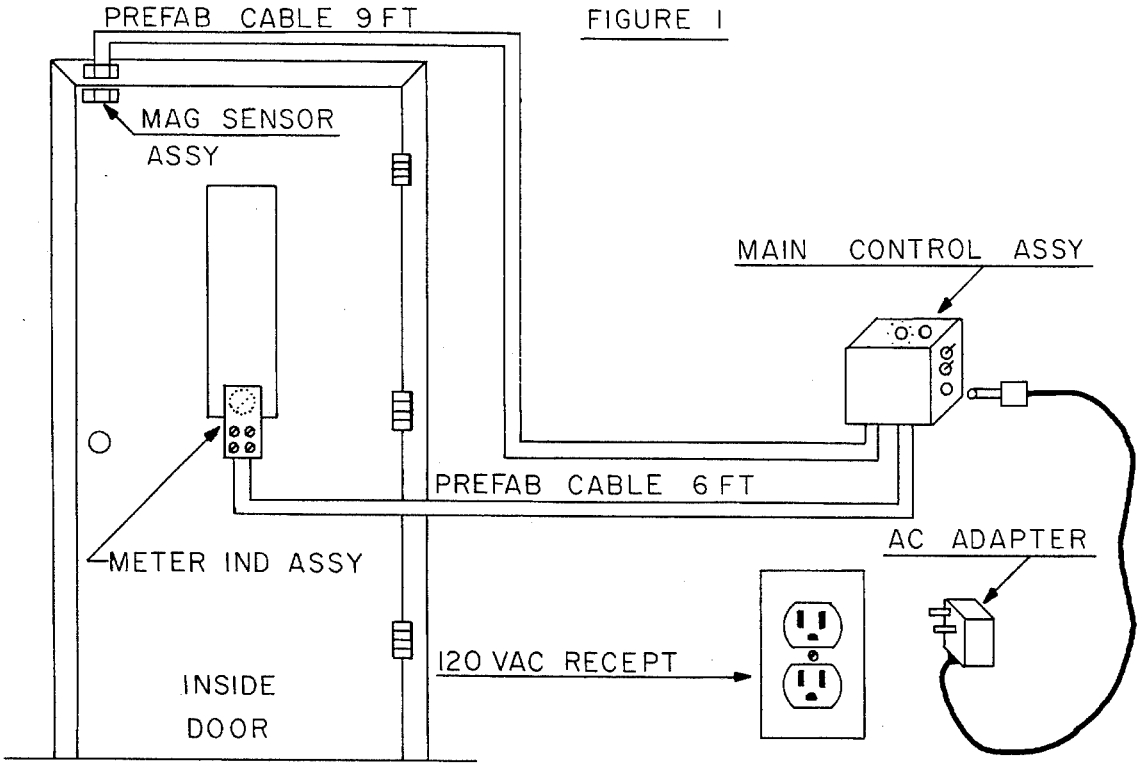
Figure 2:
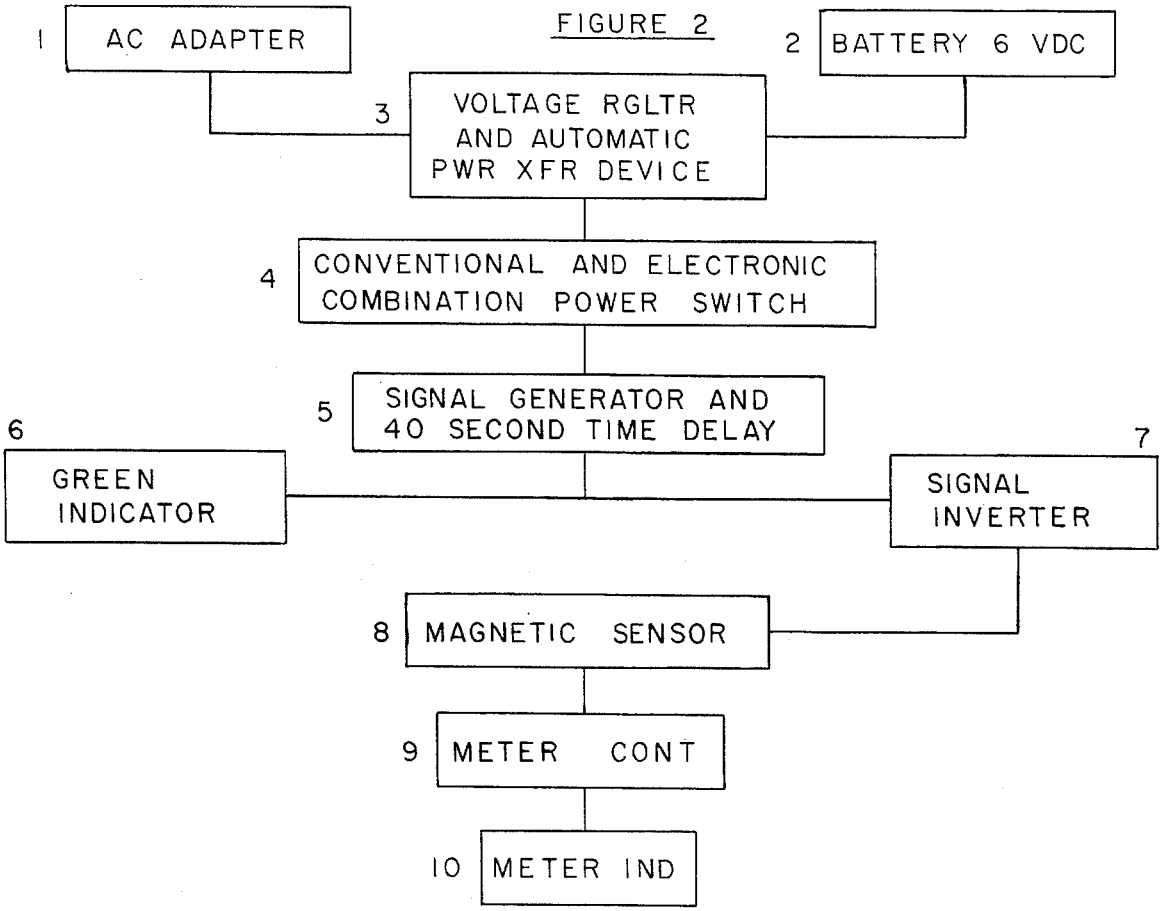
Figure 3:
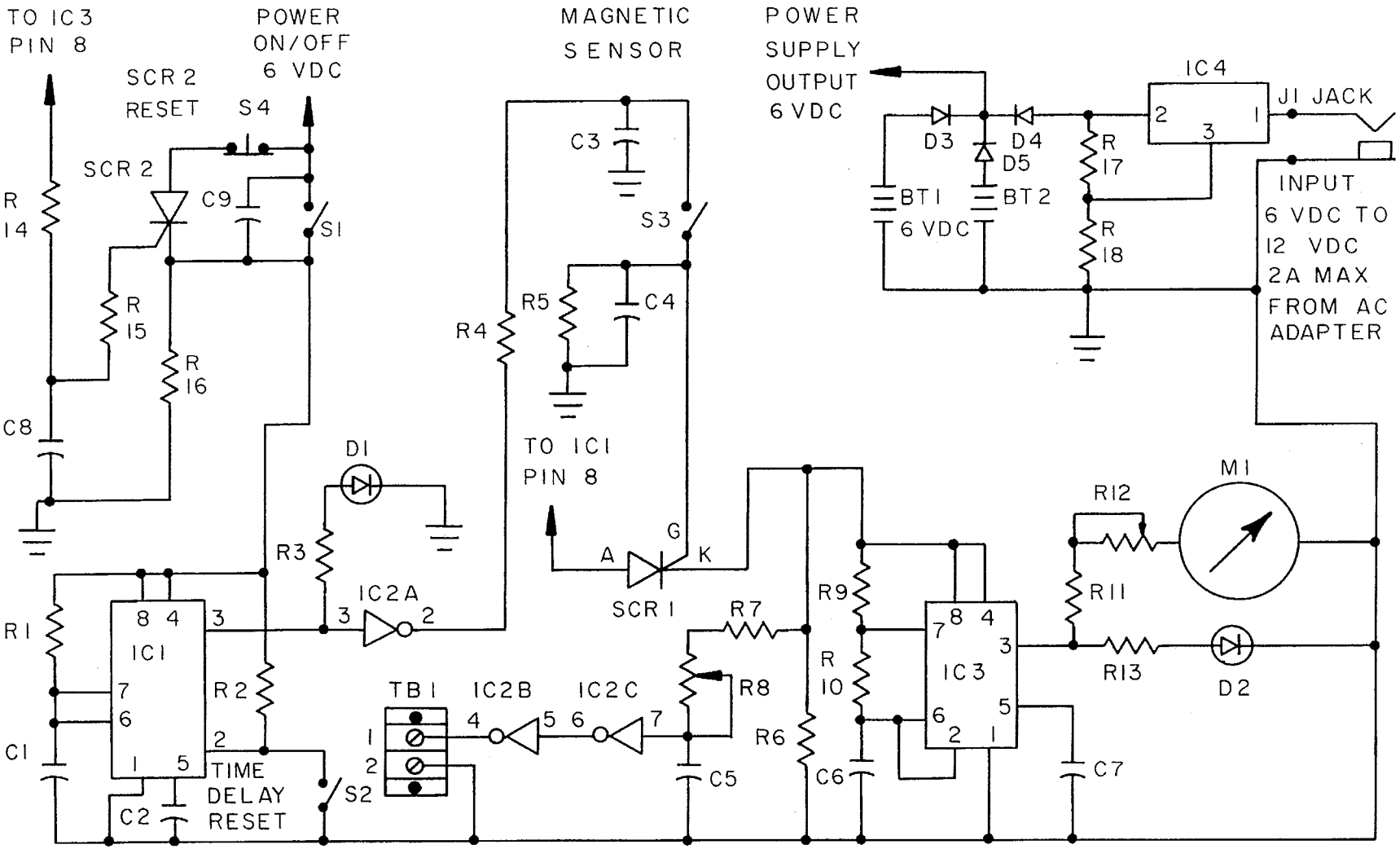

Reference FIGS. 2 and 3. This indicating system use the 120 volt commercial power through an AC Adapter (1) as a primary power source of supply. The normal 6–12 VDC input comes from the AC Adapter goes to J1 Jack. J1 is the input to the 6 VDC voltage regulator(3). This voltage regulator is configured with R17 and R18 to provide 6.1 volts DC output. Input voltage can be much greater than 12 volts DC, a +300 percent tolerance, up to 36 volts DC are typical. The output of the voltage regulator connects to the anode of semiconductor diode D4, SK9934. The 6 volt battery, BT1, (2) is connected to the anode of semiconductor diode, D3, SK9934. Another 6 volt battery, BT2(2) is connected to the anode of semiconductor diode D5, SK9934, as a back-up power supply. The cathodes of the three semiconductor diodes D3, D4, and D5 are connected together and then connects to the system power switch S1. Whenever the normal primary power fails, the instantaneous automatic power changeover (3) is accomplished through the connection arrangement of diodes D3, D4 and D5 as described above.

The Conventional and Electronic Combination Power Switch (4) are essentially having a toggle switch, S1, GC35-078, connected in parallel with a silicon controlled rectifier, SCR2, ECG5452, which enabled by an open door status signal that comes directly from the cathode of the SCR1. After the toggle switch, S1, TURN ON the power to the unit, the equipment is in fully operational status. Opening the front door then will immediately trigger the meter indicator and enable the gate of the SCR2 (conventional and electronic combination power switch) after 3 seconds delay. If the toggle switch, S1, now turned to OFF position attempt to shut off the power to the unit, in reality, the instant the toggle switch, S1, is off, the same instant the electronic switch, SCR2, comes on to cancel it so that the equipment will continue to function normally as before without any power interruption. To de-energize the equipment however, a three step procedure must be followed: 1. Closed the front door (S3 open). 2. Turn the power toggle switch, S1 to "OFF" position, 3. Momentarily press the SCR2 RESET switch, S4, until the equipment is de-energized.

IC1(5) is a signal generator, LM555CN, with a predetermined 40 second delay. The amount of time delay varies with the R-C time constant which is created by the assigned values of R1 and C1. The time delay momentary RESET switch, S2, initiate the 40 seconds delay whenever it is turned "ON" so that the user may leave the protected space and lock the door without the concern of triggering the Meter Indicator, GC20-935, M1(10). The delay signal output is on pin 3 of IC1. It connects to IC2, CD4049(7) inverter input, and the semiconductor diode, D1, XC556G, Green Indicator (6). This signal is attenuated by R3 to 1.8 volts and to limit the circuit current to 0.003 ampere before it is used to energize D1, which shows that the system is not yet fully operational for 40 seconds. D1 indicator is located on the Main Control assembly. While D1 is energized, the same +6 volt delay signal feeding IC2 is being inverted and its output signal becomes 0 volt. A zero volt level is not sufficient to control the gate of the silicon controlled rectifier (ECG 5452) even if the magnetic sensor (8) S3 is closed. However, at the end of the 40 second delay period, the output from IC1 becomes zero volt, D1 is de-energized and IC2A pin 2, signal output becomes +6 volts. This +6 volt signal is attenuated by R4 to a proper level of 0.0002 ampere circuit current to turn "ON" the gate of the silicon controlled rectifier, ECG5452, SCR1(9), whenever the magnetic sensor (8) S3 is closed. The signal will not reach the SCR1 and turn it "ON" if the door remain closed (S3 open). But the first time when the door opens following the 40 second time delay, the output signal will pass through the magnetic sensor S3 and turn "ON" the SCR1 by a very low level current of 0.0002 ampere. SCR1 is part of the Meter Control (9) circuit. It provides the operating power for IC3 astable multivibrator, LM555CN. ICI along with C6 and R10 combination determine the R-C time constant to control the rate/speed of turning the Meter Indicator (10) "ON" and "OFF" 55 times per minute (sweeping/oscillating action). The signal output from IC3 pin 3 is attenuated to a desirable level of 0.00006 ampere circuit current by R11 and R12. R12 is a variable 100000 Ohm resistor that can be adjusted so the meter deflection can rise up to ¼, ½, ¾ or full scale deflection (sweeping/oscillating action) to suit user's desire. Now, to see how it operates, let's assume that Fewer Switch (S1) is "ON", and the RESET 40 second delay switch (82) is momentarily "ON", therefore, the Green Indicator is "ON" to delay its operation for the next 40 seconds, but immediately following the 40 second delay, the front door opens (an undesirable event). The Meter Indicator, M1, immediately beginning to sweep/oscillate and it will continue to sweep/oscillate regardless how many times the door opens and closes thereafter until the user of this equipment reset the SCR1 by de-energizing the entire system. While the above description contains many specificities, these should not be construed as a limitation on the scope of the invention but rather as an exemplification of one preferred embodiment thereof. Many other variations are possible. For example, the 40 second delay can be configured to lengthened or shortened, the sweeping action of the D'arsonval Meter Indicator can be made to sweep/oscillate faster or slower, the magnetic sensor can be substituted with switch contacts, multiple magnetic sensors, and multiple Green, and meter indicators can be added to suit multiple entrance requirements.

I claim:

1. An indicating system that will show a returning occupant at a front entrance whether or not a front door has been opened since a previous security status, comprising the following:

a magnetic sensor means for sensing opening and closing of said door;

a D'arsonval meter movement indicator assembly for indicating a security status of said entrance;

an electronic circuitry means comprising a silicon controlled rectifier responsive to an output signal from said magnetic sensor means for driving said silicon controlled rectifier to an energized condition, thereupon providing a voltage from a voltage source to energize and control a sweeping movement of said D'arsonval meter movement indicator assembly to indicate a first opening or first opening and then closing alarm status of said door;

means of power supply conversion from commercial power source to a regulated power output of 6.1 VDC for said electronic circuitry means, said power supply conversion means comprising a universal AC adapter for providing a 12 VDC to an input jack of a voltage regulator to provide said regulated power output;

back-up battery to provide back-up power for said electronic circuitry means;

power transfer device comprising diodes for instantaneous automatic power changeover between said regulated power output and said back-up power to provide said voltage source, such that in case of a power failure of said commercial power source, said power changeover takes place to provide back-up power, and return to providing said regulated power whenever said commercial power is restored, without power interruption to said electronic circuitry means;

main control assembly comprising a power on/off toggle switch in parallel with a silicon controlled rectifier reset switch to enable said voltage source from said power transfer device to said electronic circuitry means, such that said voltage source is enabled even when said power on/off toggle switch is turned off from a power-on state after an opened-door alarm status signal which comes directly from said silicon controlled rectifier has been outputted, whereby said silicon controlled rectifier reset switch is enabled by said opened-door status signal, such that in order to de-energize an activated alarm condition, a three step procedure must be followed: a) close said front door, b) turn the power toggle switch off, and c) momentarily press the silicon controlled rectifier reset switch until the system is de-energized; and means to provide a variable time delay signal with a time delay duration between said electronic circuitry means and said D'arsonval meter movement indicator assembly through auxiliary signal output terminals of an occupant input terminal board to provide an occupant exit delay.

* * * * *